United States Patent [19]

Bellanger

[11] Patent Number: 4,887,339

[45] Date of Patent: Dec. 19, 1989

[54] STRIP MATERIAL WITH TAB-LIKE PARTS FOR FORMING FASTENERS

[75] Inventor: Michael P. Bellanger, Oakdale, Minn.

[73] Assignee: Minnesota Mining and Manufacturing Company, St. Paul, Minn.

[21] Appl. No.: 220,265

[22] Filed: Jul. 18, 1988

[51] Int. Cl.[4] ..... A44B 17/00

[52] U.S. Cl. ..... 24/575; 24/20 EE; 24/577

[58] Field of Search ..... 24/20 EE, 575, 576, 24/577, 578, 579, 580, 306, 450

[56] References Cited

U.S. PATENT DOCUMENTS

| | | | |
|---|---|---|---|
| 184,397 | 11/1876 | Macumber | 24/20 EE |
| 235,273 | 12/1880 | Miller | 24/20 EE |
| 3,263,292 | 8/1966 | Fekete | 24/20 EE |
| 3,869,764 | 3/1975 | Tanaka et al. | 24/577 |

FOREIGN PATENT DOCUMENTS

| | | | |
|---|---|---|---|
| 1214649 | 4/1960 | France | 24/575 |
| 0760697 | 11/1956 | United Kingdom | 24/577 |

*Primary Examiner*—Victor N. Sakran

*Attorney, Agent, or Firm*—Donald M. Sell; Walter N. Kirn; William L. Huebsch

[57] ABSTRACT

A strip of polymeric sheet material adapted to cut into lengths to form releasably engageable pieces of a fastener. The strip has a row of tab-like parts bent along bend lines out of the plane of a main part of the strip to define an opening through the strip; and the main part and tab-like parts of the strip have adjacent edge surfaces disposed at an included angle in the range of about 60 to 90 degrees with respect to the adjacent bend line so that when the tab-like parts on each of two lengths of the strip are simultaneously fully inserted through the openings in the other length with the tab-like parts projecting generally in opposite directions, the edge surfaces of the tab-like parts on one length will make frictional engagement with the edge surfaces of the main part of the strip on the other to frictionally hold the lengths in releasable engagement.

17 Claims, 2 Drawing Sheets

STRIP MATERIAL WITH TAB-LIKE PARTS FOR FORMING FASTENERS

TECHNICAL FIELD

The present invention relates to fasteners of the type having portions adapted for releasable engagement, and in one aspect to such fasteners in which both portions of the fasteners have essentially the same structure.

DISCLOSURE OF INVENTION

The present invention provides a simple, inexpensive, effective, easily made fastener that makes firm partially self aligning engagement.

According to the present invention there is provided a fastener comprising first and second pieces of stiff flexible polymeric sheet material, each piece having a plurality of aligned, equally spaced, similarly shaped and oriented, generally U shaped through slits. The slits define a row of tab-like parts of the piece and a surrounding main part of the piece. Each of the tab-like parts is bent along a bend line between the ends of the slits defining the tab-like part to project in the same direction out of the plane of the main part of the piece to define an opening through the piece beneath the tab-like part. The bend lines of the tab-like parts are parallel and extend transverse of the piece, and the main part and tab-like parts of the piece have opposed edge surfaces adjacent the opposite ends of the slits disposed at an included angle in the range of about 60 to 90 degrees (preferably about 70 to 80 degrees or 75 degrees) with respect to the adjacent bend line so that when the tab-like parts on each of the two pieces are simultaneously fully inserted through the openings in the other piece with the tab-like parts projecting generally in opposite directions, the edge surfaces of the tabs-like parts on one piece will make frictional engagement with the edge surfaces of the main part of the piece on the other to frictionally hold the pieces in releasable engagement.

The pieces can be attached to different backing layers to be releasably attached by the fastener, with the surfaces of the pieces opposite that from which the tab-like portions project against the backing layer and the pieces attached to the backing layers at positions spaced from the row of tab-like parts so that when the pieces are engaged the tab-like parts of one of the pieces can move to positions between the other piece and the backing attached to the other piece. When the backing layers are of rigid material, the pieces after engagement can only be disengaged by simultaneously sliding all of the tabs out of engagement with each other which takes an initial effort sufficient to overcome the frictional engagement between the surfaces. When the backing layers are of flexible material, the pieces after engagement can be disengaged either by simultaneouly sliding all of the tab-like portions out of engagement with each other which also takes an initial effort sufficient to overcome the frictional engagement between the surfaces, or by peeling the fastener portions apart one tab at a time, which peeling can facilitate separating the fastener portions particularly when they are used on garments, such as to fasten together tensioned elastic portions of garments such as brassieres.

The pieces of the fastener can be cut from a strip of the stiff flexible polymeric material in which the tabs can be formed by passing the strip through a rotary die assembly.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
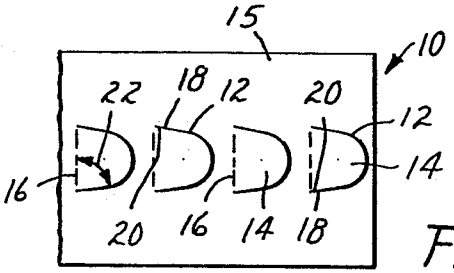
FIG. 1 is a fragmentary plan view of a strip of sheet material that is adapted to be cut into lengths to form releasably engageable portions of a fastener according to the present invention.

Referring now to the drawing, there is shown in FIG. 1 an elongate stiff flexible strip 10 of polymeric material (e.g., polypropylene in the range of about 0.025 to 0.051 centimeter (0.010 to 0.020 inch) thick) according to the present invention that is adapted to be cut into lengths to form releasably engageable pieces 11 of a fastener.

Figure 2:
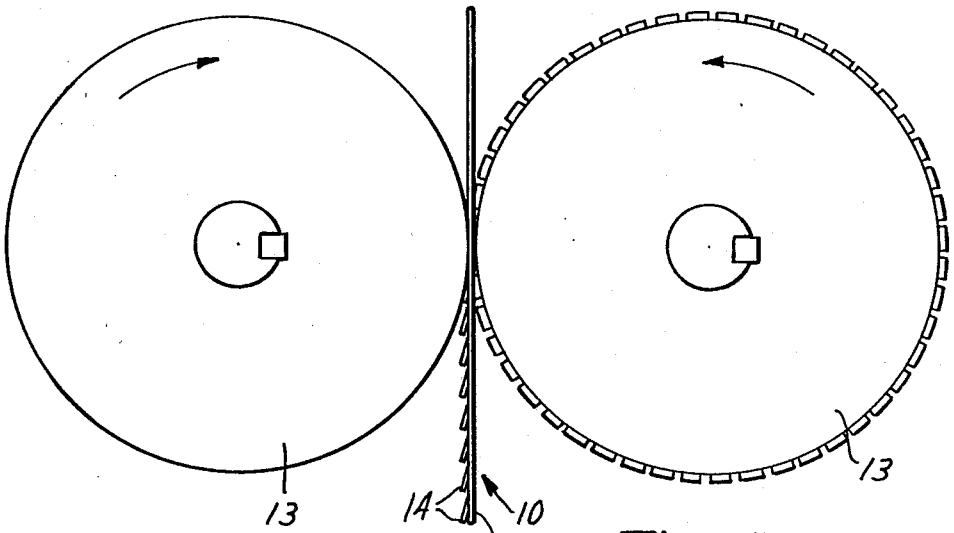
FIG. 2 is a schematic view illustrating the manufacture of the strip of sheet material of FIG. 1.

The strip 10 and each piece 11 cut from the strip 10 has a plurality of equally spaced, aligned, similarly shaped and oriented, generally U shaped slits 12 along its length, which slits 12 define a row of tab-like parts 14 of the strip 10 or piece 11, and a surrounding main part 15 of the strip 10 or piece 11. Each of the tab-like parts 14 is bent along a bend line 16 between the ends of the slit 12 defining the tab-like part 14 in the same direction out of the plane of the main part 15 of the strip 10 or piece 11 to define an opening through the strip 10 or piece 11 beneath the tab-like part 14, and the slits 12 and tab-like parts 14 in the strip 10 of sheet material 10 can easily be formed by passing a strip of the sheet material through the nip of a pair of die wheels 13 as is illustrated in FIG. 2.

Figure 6:
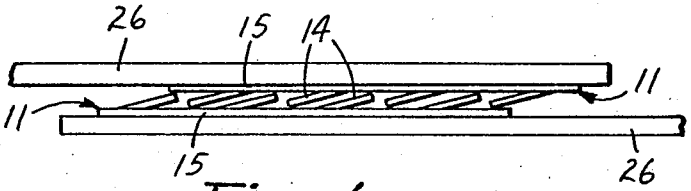
Figure 5:
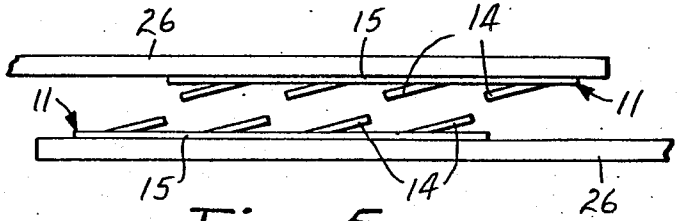

The bend lines 16 of the tab-like parts 14 are parallel and extend transverse of the strip 10 or piece 11 of sheet material such that an imaginary line perpendicular to one of the bend lines 16 and bisecting the adjacent tab-like part 14 will bisect all of the tab-like parts 14 along the strip 10 or piece 11. The tab-like parts 14 and the main part 15 of the strip 10 or piece 11 of sheet material have adjacent edge surfaces 18 and 20 respectively adjacent the opposite ends of the slits 12, which edge surfaces 18 and 20 are disposed at an included angle 22 (see FIG. 1) in the range of about 60 to 90 degrees and preferably in the range of about 70 to 80 degrees or about 75 degrees with respect to the adjacent bend line 16. With this orientation of the edge surfaces 18 and 20, when the tab-like parts 14 on each of two lengths or pieces 11 of the strip 10 of sheet material are simultaneously fully inserted through the openings in the other piece 11 of sheet material with the tab-like parts 14 projecting generally in opposite directions (as is sequentially illustrated in FIGS. 5–7 in which the pieces 11 being engaged are attached to backing layers 26), the edge surfaces 18 of the tab-like parts 14 on one piece 11 will make frictional engagement with the edge surfaces 20 of the main part 15 of the other piece 11 (see FIG. 8) to frictionally hold the pieces 11 in releasable engagement.

Figure 3:
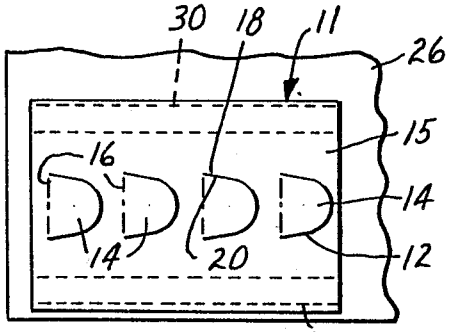
FIG. 3 is a plan view illustrating the sheet material of FIG. 1 attached to a backing.
Figure 4:
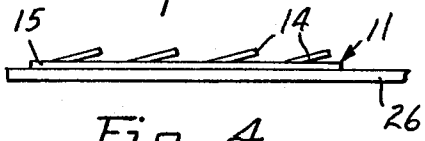
FIG. 4 is a side view illustrating the sheet material of FIG. 1 attached to a backing.
Figure 8:
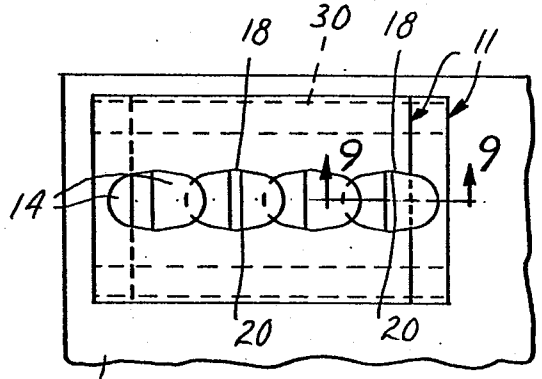
FIG. 8 is a sectional view taken approximately along line 8—8 of FIG. 7.
Figure 9:
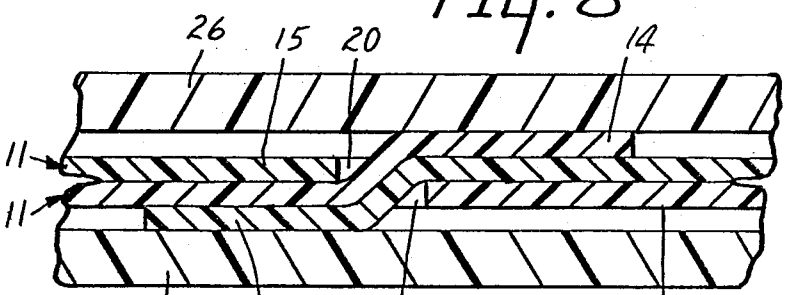
FIG. 9 is an enlarged fragmentary sectional view taken approximately along line 9—9 of FIG. 8.
Figure 7:
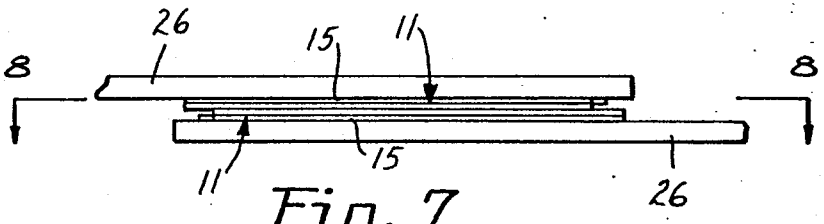
FIGS. 5, 6, and 7 are side views sequentially illustrating engagement of two pieces of the sheet material of FIG. 1 attached to a backing.

Typically when the two pieces 11 are used as a fastener they are each attached to a different backing layer 26 as is illustrated in FIGS. 3 and 4 for one of the pieces 11 and in FIGS. 7–9 for two of the pieces 11. The pieces 11 are each attached along one of the surfaces of the backing layer 26 with the tab-like parts 14 of the piece projecting away from the backing layer 26, and the pieces are attached to the backing layer 26 (e.g., by staples, sewing stitches, adhesive or fusion as by ultrasonic welding) at positions 30 parallel to and spaced from the sides of the row of tab-like parts 14 so that when the pieces 11 are engaged, the tab-like parts 14 of one of the pieces 11 will be positioned between the other piece 11 and the backing 26 attached to the other piece, as can best be seen in FIG. 9.

Figure 10:
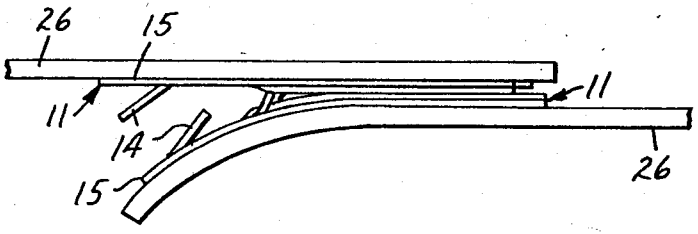
FIG. 10 is a side view illustrating partial separation of two engaged pieces of the sheet material of FIG. 1 attached to a flexible backing.

When the backing layers 26 are of rigid material, the pieces 11 after engagement can only be disengaged by simultaneously sliding all of the tab-like parts 14 out of engagement with each other which takes an initial effort sufficient to overcome the frictional engagement between the surfaces 18 and 20. When the backing layers 26 are of flexible material, however, the pieces 11 after engagement can be disengaged either by simultaneously sliding all of the tab-like parts 14 out of engagement with each other (which also takes an initial effort sufficient to overcome the frictional engagement between the surfaces 18 and 20), or by peeling the pieces 11 apart from one end to disengage two tab-like parts 14 at a time as is illustrated in FIG. 10. Such peeling can facilitate separating the pieces 11 particularly when they are used on garments.

As one preferred example, the tab-like parts 14 on a piece 11 made from 0.015 inch thick polypropylene can have a width along the bend line 16 of about 0.25 inch, an angle 22 of 75 degrees, a length at right angles to the bend line 16 of about 3/16 inch and a tip radius opposite the bend line 16 of about 3/32 inch about a center spaced at a right angle from the bend line 16 by about 3/64 inch, and the bend lines 16 of the tab-like parts 14 along the piece 11 can be spaced by about 9/16 inch.

The present invention has now been described with reference to one embodiment thereof. It will be apparent to those skilled in the art that many changes can be made in the embodiment described without departing from the scope of the present invention. For example, while rounded tips on the tab-like parts 14 are prefered for most uses, triangular tips may also be useful for some purposes; and other sheet materials such as metal or polymeric sheet material of polyester or nylon may be preferred for certain uses. Thus the scope of the present invention should not be limited to the structures described in this application, but only by structures described by the language of the claims and the equivalents of those structures.

I claim:

1. An elongate stiff flexible strip of polymeric sheet material adapted to be cut into lengths to form releasably engageable pieces of a fastener, said strip having a plurality of equally spaced, aligned, similarly shaped and oriented, generally U shaped slits along its length, said slits defining a row of tab-like parts of said strip and a surrounding main part of said strip, each of said tab-like parts being bent along a bend line between the ends of the slit defining the tab-like part out of the plane of the main part of said strip to define an opening through said strip, said bend lines of said tab-like parts being parallel and extending transverse of said strip, and said main part and tab-like parts of the strip having adjacent edge surfaces adjacent the opposite ends of said slits disposed at an included angle in the range of about 60 to 90 degrees with respect to the adjacent bend line so that when the tab-like parts on each of two lengths of said strip are simultaneously fully inserted through the openings in the other length with the tab-like parts projecting generally in opposite directions, said edge surfaces of the tab-like parts on one length will make frictional engagement with said edge surfaces of the main part of the strip on the other to frictionally hold the lengths in releasable engagement.

2. An elongate strip according to claim 1 wherein said included angle is in the range of about 70 to 80 degrees.

3. An elongate strip according to claim 1 wherein said included angle is about 75 degrees.

4. An elongate strip according to claim 1 wherein said sheet material is in the range of about 0.025 to 0.051 centimeter (0.010 to 0.020 inch) thick.

5. An elongate strip according to claim 1 wherein said sheet material is polypropylene in the range of about 0.025 to 0.051 centimeter (0.010 to 0.020 inch) thick.

6. A fastener comprising first and second pieces of stiff flexible polymeric sheet material, each piece having opposite major surfaces, a plurality of aligned, equally spaced, similarly shaped and oriented, generally U shaped through slits, said slits defining a row of tab-like parts of said piece and a surrounding main part of said piece, each of said tab-like parts being bent along a bend line between the ends of the slit defining the tab-like part out of the plane of the main part of the piece to define an opening through said piece, said bend lines of said tab-like parts being parallel and extending transverse of said piece, and said main part and tab-like parts of the piece having opposed edge surfaces adjacent the opposite ends of said slits disposed at an included angle in the range of about 60 to 90 degrees with respect to the adjacent bend line so that when the tab-like parts on each of said two pieces are simultaneously fully inserted through the openings in the other piece with the tab-like parts projecting generally in opposite directions, said edge surfaces of the tabs-like parts on one piece will make frictional engagement with the edge surfaces of the main part of the piece on the other to frictionally hold the pieces in releasable engagement.

7. A fastener according to claim 6 wherein said included angle is in the range of about 70 to 80 degrees.

8. A fastener according to claim 6 wherein said included angle is about 75 degrees.

9. A fastener according to claim 6 wherein said sheet material is in the range of about 0.025 to 0.051 centimeter (0.010 to 0.020 inch) thick.

10. A fastener according to claim 6 wherein said sheet material is polypropylene in the range of about 0.025 to 0.051 centimeter (0.010 to 0.020 inch) thick.

11. In combination, a fastener comprising first and second pieces of stiff flexible polymeric sheet material, each piece having opposite major surfaces, a plurality of aligned, equally spaced, similarly shaped and oriented, generally U shaped through slits, said slits defining a row of tab-like parts of said piece and a surrounding main part of said piece, each of said tab-like parts being bent along a bend line between the ends of the slit defining the tab-like part out of the plane of the main part of the piece to define an opening through said piece, said bend lines of said tab-like parts being parallel and extending transverse of said piece, and said main part and tab-like parts of the piece having opposed edge surfaces adjacent the opposite ends of said slits disposed at an included angle in the range of about 60 to 90 degrees with respect to the adjacent bend line so that when the tab-like parts on each of said two pieces are simultaneously fully inserted through the openings in the other piece with the tab-like parts projecting generally in opposite directions, said edge surfaces of the tabs-like parts on one piece will make frictional engagement with the edge surfaces of the main part of the piece on the other to frictionally hold the pieces in releasable engagement; and first and second backing layers, one of the backing layers attached along the surface opposite the projecting tab-like parts of a different one of the pieces at positions spaced from the row of tab-like parts so that when the pieces are engaged the tab-like parts of one of the pieces will be positioned between the other piece and the backing layer attached to the other piece.

12. A combination according to claim 11 wherein said backing layers are rigid.

13. A combination according to claim 11 wherein said backing layers are flexible.

14. A combination according to claim 11 wherein said included angle is in the range of about 70 to 80 degrees.

15. A combination according to claim 11 wherein said included angle is about 75 degrees.

16. A combination according to claim 11 wherein said sheet material is in the range of about 0.025 to 0.051 centimeter (0.010 to 0.020 inch) thick.

17. A combination according to claim 11 wherein said sheet material is polypropylene in the range of about 0.025 to 0.051 centimeter (0.010 to 0.020 inch) thick.

* * * * *